US008495990B1

(12) United States Patent
Rivera et al.

(10) Patent No.: US 8,495,990 B1
(45) Date of Patent: Jul. 30, 2013

(54) PRE-INJECTION FUEL ATOMIZATION SYSTEM

(71) Applicants: Joey Rivera, Sellersberg, IN (US); Neal Branstetter, New Albany, IN (US)

(72) Inventors: Joey Rivera, Sellersberg, IN (US); Neal Branstetter, New Albany, IN (US)

( * ) Notice: Subject to any disclaimer, the term of this patent is extended or adjusted under 35 U.S.C. 154(b) by 0 days.

(21) Appl. No.: 13/799,563

(22) Filed: Mar. 13, 2013

Related U.S. Application Data

(60) Provisional application No. 61/620,220, filed on Apr. 4, 2012.

(51) Int. Cl.
*F02M 27/08* (2006.01)

(52) U.S. Cl.
USPC ..... 123/557; 123/590; 123/538

(58) Field of Classification Search
USPC ..... 123/536, 538, 557, 590
See application file for complete search history.

(56) References Cited

U.S. PATENT DOCUMENTS

| | | | | |
|---|---|---|---|---|
| 3,857,375 | A * | 12/1974 | Jackson | 123/587 |
| 3,914,353 | A * | 10/1975 | Cherry | 261/1 |
| 4,524,746 | A * | 6/1985 | Hansen | 123/538 |
| 4,862,858 | A * | 9/1989 | Goldsberry | 123/538 |
| 5,671,701 | A * | 9/1997 | O'Donnell | 123/25 A |
| 6,273,071 | B1 | 8/2001 | De Lima | |
| 6,276,347 | B1 | 8/2001 | Hunt | |
| 6,978,770 | B2 | 12/2005 | Rauznitz et al. | |
| 7,500,479 | B2 * | 3/2009 | Nichols et al. | 128/200.23 |
| 7,775,196 | B2 * | 8/2010 | Suzuki et al. | 123/538 |
| 7,892,301 | B2 | 2/2011 | Waters et al. | |
| 2009/0212127 | A1 | 8/2009 | Reynolds et al. | |
| 2009/0288647 | A1 * | 11/2009 | Suzuki et al. | 123/538 |
| 2011/0265737 | A1 | 11/2011 | Ryon | |
| 2012/0060802 | A1 * | 3/2012 | Livingston | 123/590 |

* cited by examiner

*Primary Examiner* — Erick Solis
(74) *Attorney, Agent, or Firm* — Goldstein Law Offices, P.C.

(57) ABSTRACT

A pre-injection fuel atomization system for a combustion engine that reduces droplet size of incoming fuel at air intake, creating an aerosol that is injected by fuel injectors into the combustion chambers. The system uses a vibrating crystal in a transducer, the vibrations atomizing the fuel into an aerosol. The droplet size is reduced to around 0.1 microns, providing more surface area available for fast surface combustion. The fuel droplets are maintained in a stoichiometric ratio to oxygen in the air so that burning is complete and clean.

20 Claims, 10 Drawing Sheets

PRE-INJECTION FUEL ATOMIZATION SYSTEM

CROSS-REFERENCE TO RELATED APPLICATIONS

This application is a nonprovisional utility application of the provisional patent application Ser. No. 61/620,220 filed in the United States Patent Office on Apr. 4, 2012 and claims the priority thereof and is expressly incorporated herein by reference in its entirety.

TECHNICAL FIELD

The present disclosure relates generally to a pre-injection fuel atomization system for a combustion engine. More particularly, the present disclosure relates to a pre-injection fuel atomization system for a combustion engine that increases fuel efficiency and lowers emissions.

BACKGROUND

Combustion engines burn approximately 20% of the liquid fuel that is injected into the combustion chamber. The remaining fuel is discarded through the engine's exhaust, resulting in low fuel efficiency and high emissions.

Rising fuel prices, along with a desire for energy independence, has prompted many to seek ways of improving fuel efficiency in combustion engines. Many modern engines have fuel injector systems and some have proposed modifications to these systems, such as exciting the fuel molecules with sonic waves generated by a piezoelectric current. Others have proposed reforming the fuel by forming cavitation bubbles.

One proposal is to use fuel in a supercritical fluid state by pressurizing and heating the fuel to the characteristic supercritical point.

Many additives have been suggested to add to the fuel such as low molecular weight polymers. Additives particularly are problematic because they interfere with the catalytic converter used by larger engines in automobiles to reduce emissions.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An object of an example embodiment of the present disclosure is to provide a system that increases fuel efficiency. Accordingly, an example embodiment of the present disclosure is a pre-injection fuel atomization system that decreases the droplet size of the fuel thereby increasing fuel efficiency by increasing surface are of the droplets.

Another object of an example embodiment of the present disclosure is to provide a system that decreases emissions from fuel consumption. Accordingly, an example embodiment of the present disclosure is a pre-injection fuel atomization system that decreases the droplet size of the fuel resulting in a more complete combustion and therefore cleaner burn and decreased emissions.

A further object of an example embodiment of the present disclosure is to provide a system that is more economical by decreasing the amount of fuel spent per mile or per time period. Accordingly, an example embodiment of the present disclosure is a pre-injection fuel atomization system that increases fuel efficiency thereby decreasing the amount of fuel spent per mile or per time period.

Herein is disclosed a pre-injection fuel atomization system for a combustion engine that reduces the droplet size of the incoming fuel at the air intake, creating an aerosol that is injected by the fuel injectors into the combustion chambers. The system uses reverse piezo electricity that directs a square wave signal from an ignition system to a crystal in a transducer transforming the wave into mechanical energy, causing the crystal to deform between convex and concave conformations at MHz frequencies. The crystal vibrations atomize the fuel into an aerosol. The droplet size is reduced to a range of 0.8 microns (μm) to around 0.1 microns (μm), providing more surface area available for faster vaporization and more efficient combustion. The smaller lighter droplets burn faster, more completely and thus more cleanly. The fuel droplets are maintained in a stoichiometric ratio to oxygen in the air so that burning is complete and clean. Any ethanol fuel, if present, rapidly burns off first. Any larger heavier droplets burn at a normal rate as they are injected into the fuel injector and concurrently cool the exhaust valves so that all temperatures within the system stay within normal operating ranges so that related systems such as the fuel injectors, catalytic converters and other system do not have to be adjusted.

The present disclosure addresses at least one of the foregoing disadvantages described hereinabove. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
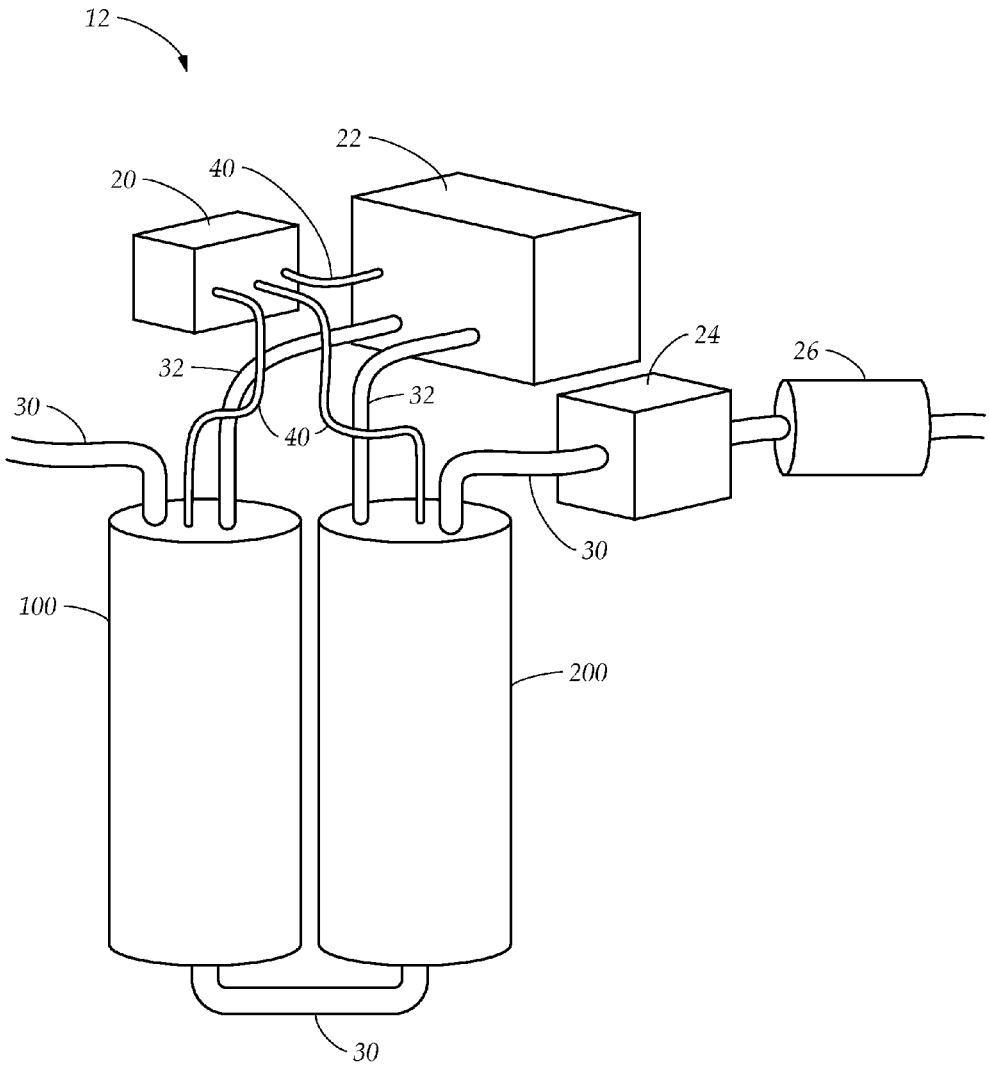
FIG. 1 is a schematic diagram of a pre-injection fuel atomization system for a small engine, showing a fuel holding chamber and a transducer chamber.

FIG. 1 illustrates a pre-injection fuel atomization system 12 for an internal combustion engine. The system as disclosed hereinbelow in different example embodiments, solves the design problems inherent in conventional electronic fuel injection systems that contribute to poor fuel economy, namely poor control of the air to fuel ratio combined with an inefficient adjustment of the injector to properly mix air and fuel at a ratio that do not take advantage of the heat to pressure ratio in the engine.

Fuel is delivered to a fuel holding chamber 100 from a fuel pump and is transferred to a transducer chamber 200, the transducer chamber in fluid communication with the fuel holding chamber. A transducer, described hereinbelow, in the transducer chamber produces an aerosol of fuel by reverse piezoelectricity from a resonating crystal that increases the kinetic energy of the fuel. The aerosol is further transferred to an engine fuel injection (EFI) system. In this disclosure, an aerosol is a suspension of particles in air, the particles having the equivalent kinetic energy, and in equilibrium with, the pressure of the suspending air. In this disclosure, the particles are microscopic droplets of liquid fuel.

The crystal in the transducer receives an electrical signal from a controller 20 and the crystal vibrates at a frequency about 1.7 MHz, the crystal in the transducer deforming between convex and concave conformations. The controller is in electrical communication with an ignition system of the combustion engine, the ignition system producing a square wave signal. The crystal advantageously exploits the square wave signal from the ignition system to control the crystal deformation, the crystal deforming in response to the square wave signal, converting the signal to mechanical energy. The frequency is optimum for atomizing a plurality of fuel hydrocarbons having a range of seven to twelve carbon ($C_7$ to $C_{12}$) atoms that make up typical fuel used in internal combustion engines. The vibrations caused by the deformation atomize the fuel into an aerosol having a droplet size generally ranging from 0.8 microns to below 0.1 microns, having a small unquantifiable but not insignificant portion of the aerosol below 0.1 microns, 0.1 micron established as the droplet size in the portion below a threshold that can be accurately quantified by current technology.

Reducing the droplet size creates the aerosol having a significantly increased surface area per volume of fuel. Increased surface area allows for more rapid vaporization and combustion, thereby increasing the fuel efficiency of the fuel.

It is well known to those of ordinary skill that increasing surface area increases a chemical reaction rate for a reaction such as combustion of fuel with oxygen in the present discussion. Fuel only burns in a gaseous state so increasing the surface area of a droplet increases the rate of evaporation, increasing fuel vapor. Reducing the droplet size to increase surface area thereby increases the rate of evaporation and the rate of reaction thus producing better fuel economy and a cleaner burning, thereby reducing emissions. In conventional EFI systems, only the surface of the large droplet evaporates, leaving behind a portion of the droplet in a liquid state, which is exhausted in an unburnt state.

The controller 20 regulates a flow rate of fuel into the fuel holding chamber 100 and further regulates the flow rate and a volume of fuel from the fuel holding chamber 100 into the transducer chamber 200. The controller is in electrical communication with an ignition system. As it is well known to those of ordinary skill, the ignition system controls the distribution of fuel into a fuel-injection system through a square wave signal. Ignition systems are well known to those of ordinary skill.

The controller exploits the square wave signal from the ignition system to control the pre-injection fuel atomization system, so that the atomization system produces the atomized fuel aerosol as needed in the fuel-injection system. The controller further controls the fuel flow rate and fuel volume to the transducer so that all hydrocarbons are completely atomized into the aerosol when in communication with the transducer without overwhelming the transducer.

Figure 5:
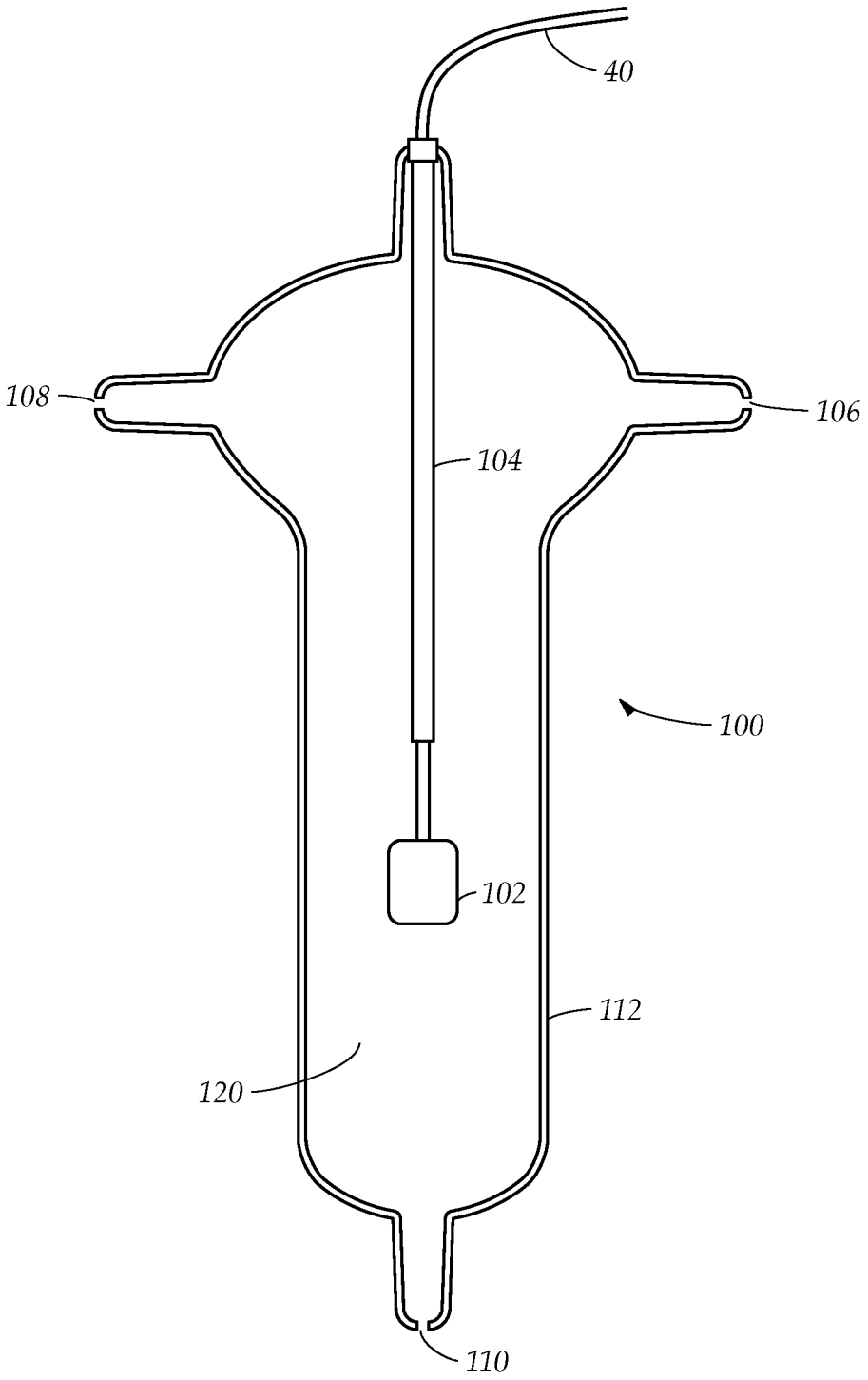
FIG. 5 is a front elevational view of the fuel holding chamber.

FIG. 5 illustrates the fuel holding chamber 100, showing an interior 120 of the chamber, the chamber having a wall 112 defining the interior space 120. The fuel holding chamber has a float 102 the monitors the amount of fuel in the chamber and signals the amount as determined by the float's position in the chamber. The float 102 is suspended from a rod 104. The float is electrically connected to and in communication with the controller through an electrical signal wire 40. The controller determines an amount of fuel that is required in the chamber in order to expose a predetermined amount of fuel to the transducer chamber, adding fuel to the chamber as indicated by the float's position.

Fuel enters the chamber through a fuel inlet port 108, the amount determined by the controller signally the ignition system and is transferred through the fuel outlet port 110 as demanded to maintain the predetermined amount of fuel at the transducer. Air enters the chamber through the air port 106 to maintain atmospheric pressure and aid in the transfer from the fuel holding chamber to the transducer chamber.

Figure 6:
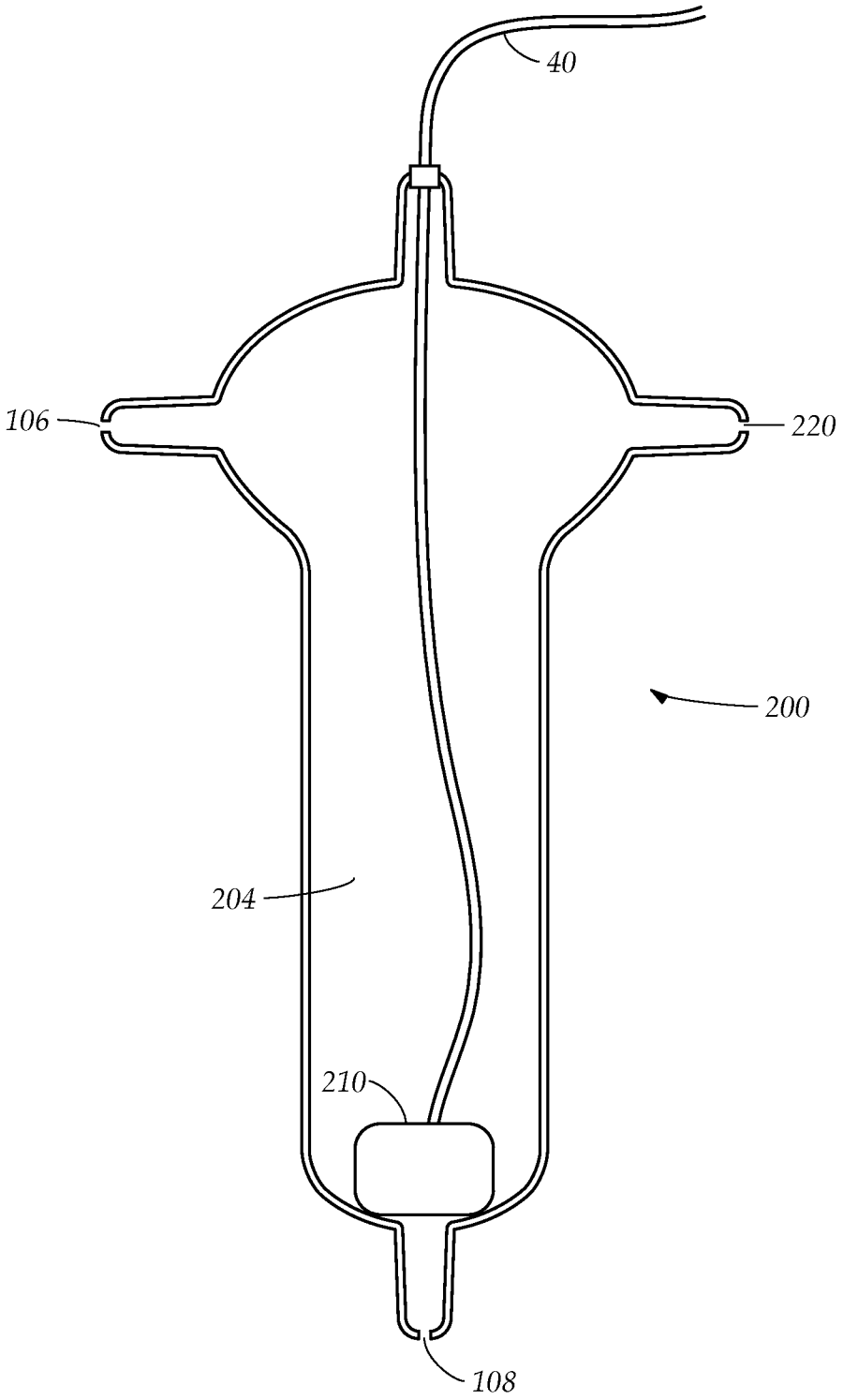
FIG. 6 is a front elevational view of the transducer chamber.

FIG. 6 illustrates the transducer chamber 200, the chamber having a wall 202 defining the chamber interior 204, which is shown in the drawing. The transducer 210 includes the crystal that vibrates as explained hereinabove. The fuel holding chamber regulates the fuel flow and volume as discussed hereinabove such that the fuel flow and volume above the crystal assures complete atomization of all hydrocarbons, the vibrations of the crystals atomizing the fuel into a plurality of ultra small microscopic droplets, the droplets forming an aerosol suspended in an atmosphere above the transducer 210. The droplets in the aerosol vary in size from below a detectable size of 0.1 microns (μm) to approximately 0.8 microns (μm), far smaller than droplets typically produced by conventional fuel injectors that produce in a typical range of 10 to 100 microns. Within the aerosol, fractionation occurs by molecular weight, the smaller, lighter droplets having a mixture of molecules with a distribution of lighter molecular weight and larger, heavier droplets having a mixture with higher molecular weight.

In one embodiment, the transducer chamber 200 is at atmospheric pressure as the aerosol forms in the transducer, droplets larger than 0.8 μm drop back to the transducer for reprocessing into droplets having a size in the range of the aerosol, the larger droplets transported by a harvest line as explained hereinbelow. The larger droplets typically have a higher molecular weight distribution. The lighter, smaller droplets naturally float to the top of the chamber and are delivered to the next process, the embodiments of which are described hereinbelow.

Figure 4:
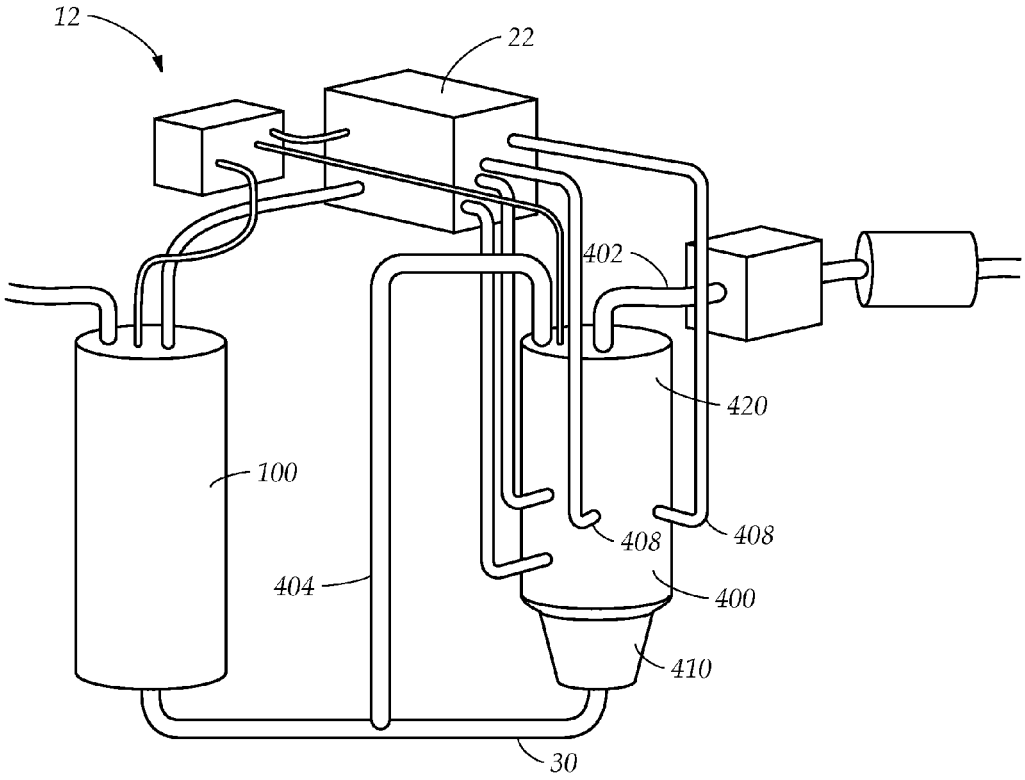
FIG. 4 is a schematic diagram of another embodiment of the pre-injection fuel atomization system for an engine, showing the fuel holding chamber and a combined transducer manifold chamber.

FIG. 4 shows a further embodiment of the system 12. The transducer is in a combined transducer manifold chamber 400 having a wall defining the interior space. The fuel holding chamber 100 is in fluid communication with the combined chamber 400 as described hereinabove. The combined chamber has a bottom portion 410 having the transducer and further having a top portion 420 having a manifold. The manifold has a plurality of air ports 408 connecting to a blower 22 for air to enter into the chamber, creating a vortex. The air vortex moves the smaller droplets into a low pressure conduit 402 for further processing. The low pressure conduit has about 2.7 W.G pressure differential compared to the chamber. The smaller droplets in the transfer conduit range in size up to 0.2 μm.

The air vortex moves the larger droplets having a higher molecular weight fraction towards the walls of the chamber and falling back to the transducer in the bottom portion of the chamber, the larger droplets as a non-limiting example in the fraction having a particle size around 0.8 microns. In one embodiment, the larger droplets exit the top portion into a harvesting line 404 and remix with the fuel passing through a fuel hose 30 from the fuel holding chamber 100 into the combined chamber 400 to encounter the transducer. The reprocessing in the transducer forms the smaller droplet size, gradually reducing the quantity of larger droplets in the fuel, the smaller droplet having a greater surface area per volume, burning more efficiently and thereby, the fuel overall burning more efficiently.

Figure 2:
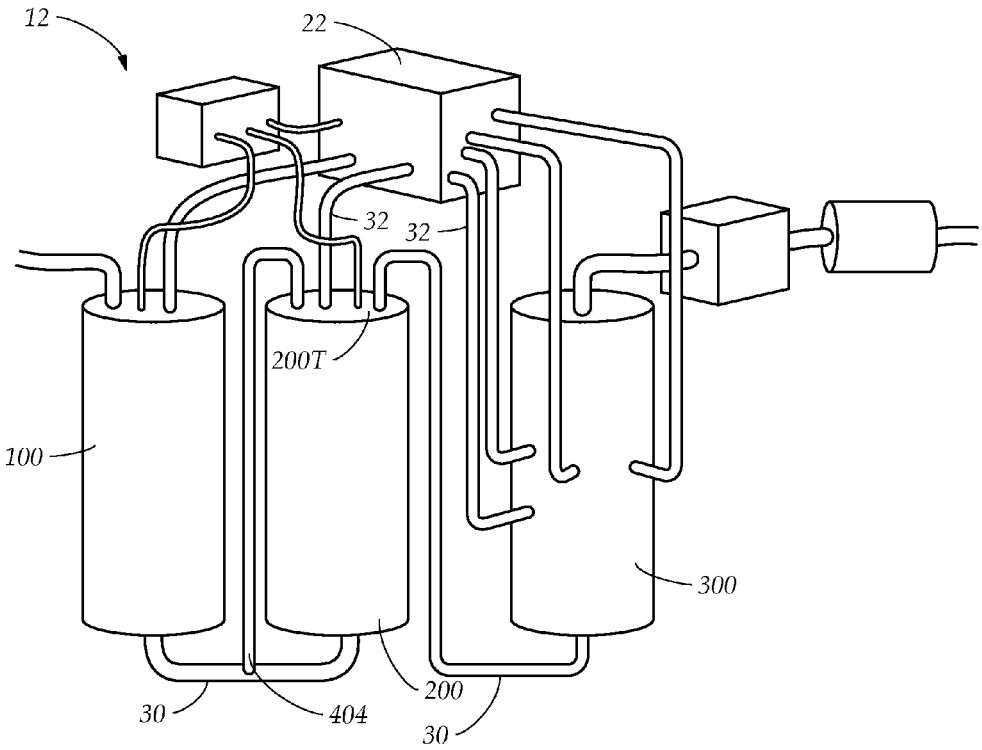
FIG. 2 is a schematic diagram of a further embodiment of the pre-injection fuel atomization system for an engine, showing the fuel holding chamber, the transducer chamber and a manifold chamber.

FIG. 2 shows yet another embodiment of the system 12. In this embodiment, the transducer chamber 200, having a top portion 200T, and the manifold chamber 300 are separate chambers. The fuel holding chamber 100 is in communication with the transducer chamber 200 through a first fuel hose 30 and the transducer chamber is in communication with the manifold through a second fuel hose 30. The blower 22 connects to the manifold and further connects to the transducer chamber through air hoses 32. The air entering the manifold chamber creates a vortex that rapidly draws the aerosol from the manifold chamber 200. Gravitational forces cause the larger droplets containing higher molecular weight fuel to fall back to the transducer or the centrifugal forces of the vortex cause the larger droplets to exit the top 200T of the transducer chamber into a harvesting line 404 and remix with the fuel passing through the fuel hose 30 from the fuel holding chamber 100 into the chamber 200 to encounter the transducer.

Figure 9:
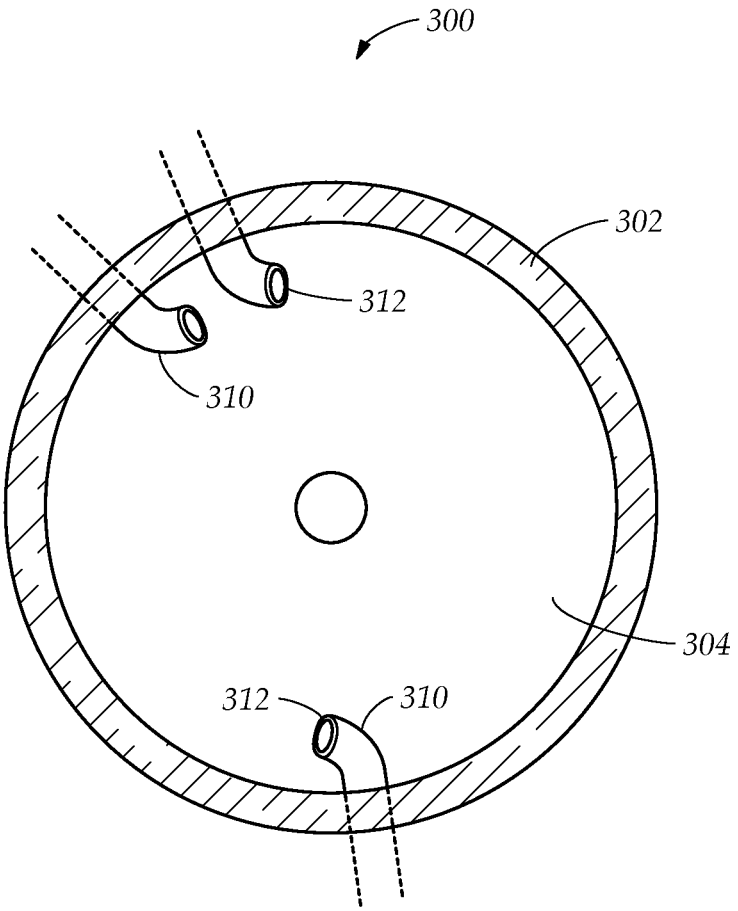
FIG. 9 is a top plan view of a manifold chamber.

FIG. 9 shows a top plan view of the manifold chamber 300. The manifold chamber 300 has a wall defining a chamber interior 304. In the chamber wall is a plurality of openings, each opening have a curved channel 310 having an end opening 312 directed in an arch back to the wall 302, creating the vortex when air and aerosol enter the chamber.

Figure 3:
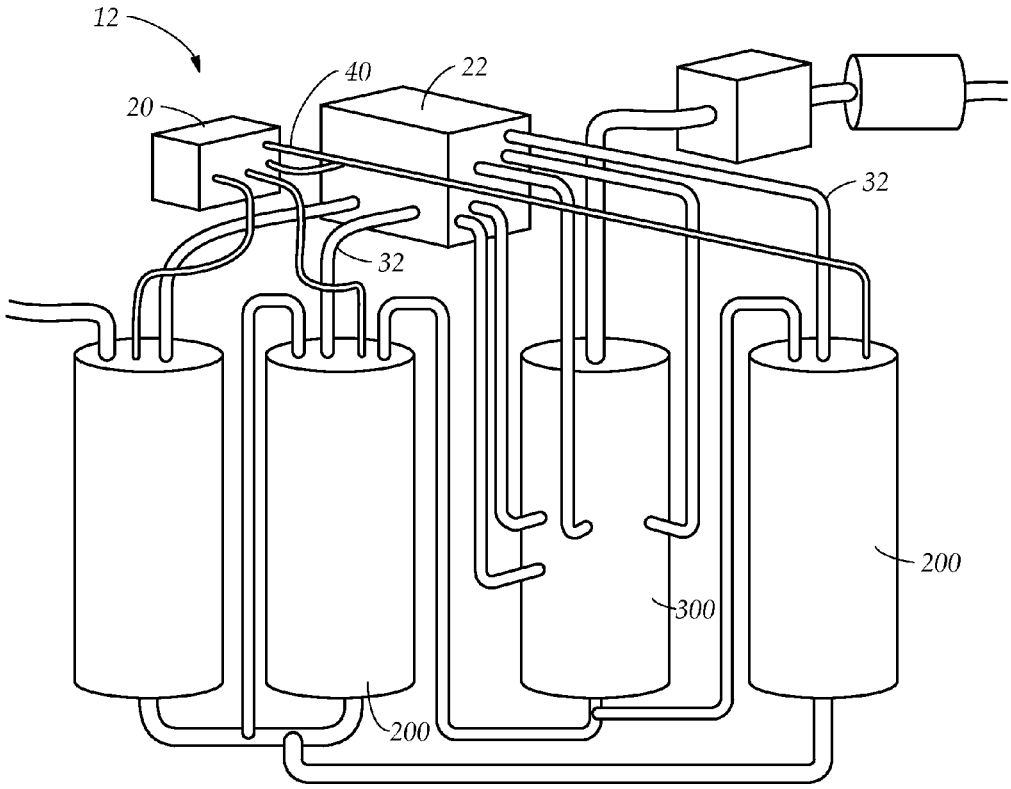
FIG. 3 is a schematic diagram of yet a further embodiment of the pre-injection fuel atomization system for a larger engine, showing the fuel holding chamber, a pair of transducer chambers and a manifold chamber.

FIG. 3 shows yet a further embodiment of the system 12. In this embodiment, two transducer chambers are in a parallel configuration and each are separately in communication with the fuel holding chamber 100 and the manifold chamber 300 through a plurality of fuel hoses 30. Each transducer chamber has a transducer in electrical communication with the controller 20 by a plurality of electrical signal wire 40 and in communication with a blower 22 by a plurality of air hoses 32.

It is understood by those of ordinary skill, that a plurality of transducer chambers in parallel configuration are possible, each separately in communication with the fuel holding chamber and manifold chamber. The number of transducer chambers varies according to the size of the engine for which the system is providing fuel.

Figure 7:
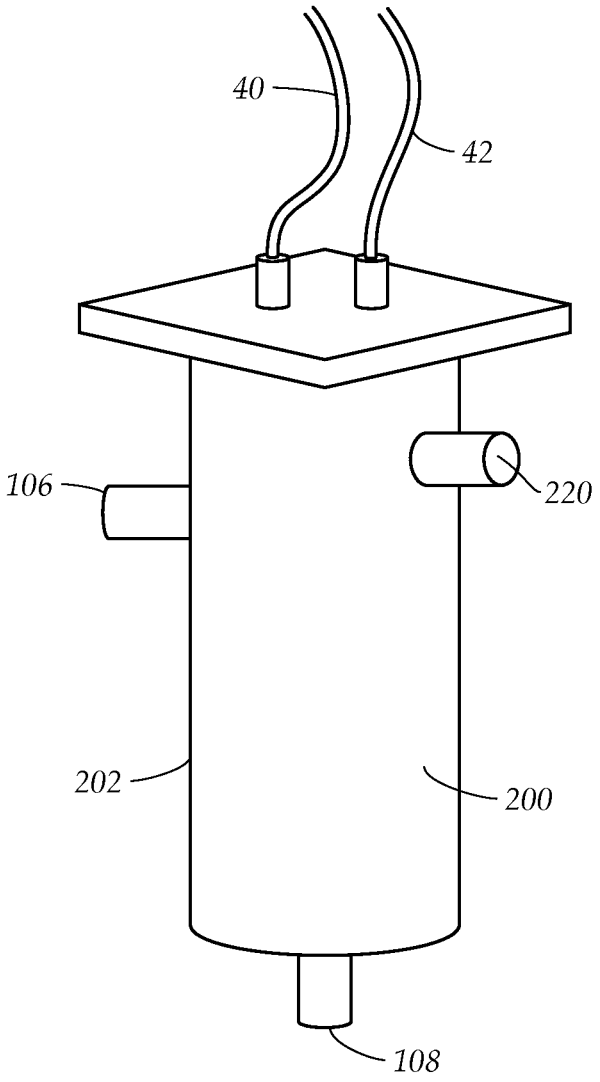
FIG. 7 is a perspective view of an exterior of a transducer chamber.

FIG. 7 shows an exterior view of the transducer chamber 200 for installation in the system. The chamber has the signal wire 40 that electrically connects the transducer inside the chamber to the controller. Additionally, the chamber has a ground wire 42. The chamber has a bottom inlet port 108, an air port 106 and the aerosol port 220 for the fuel to move further in the process, eventually moving toward a fuel injection system of the engine.

Figure 8:
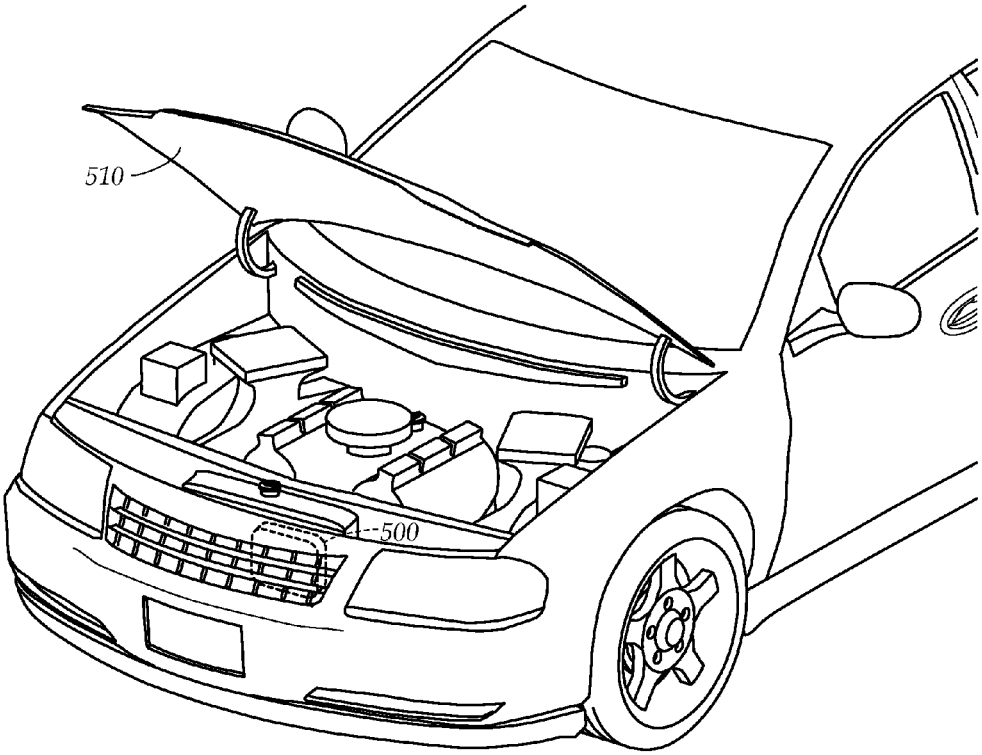
FIG. 8 is a perspective view of the pre-injection fuel atomization system installed in a vehicle.

FIG. 8 shows the system enclosed in a housing 500, mounted under a vehicle hood 510. The controller, fuel holding chamber and transducer chamber are housed therein and fuel hoses, air hoses and electrical signal wire, which are not shown, connect the system to the ignition system and the fuel-injection system. If the system is not functioning, fuel passes through from the ignition system to the fuel-injection system without disruption. The system does not require any additives to the fuel to achieve greater efficiency and thus is compatible with a plurality of catalytic converters used to reduce emissions.

Referring to FIG. 1, the controller is in electrical communication through electrical signals wires 40 with the air blower 22, the float in the fuel holding chamber 100 and the transducer in the transducer chamber 200. The blower connects to the chambers by air hoses 32. Fuel enters the fuel holding chamber and transfer to the transducer chamber through fuel hoses 30. In still a further embodiment, after processing in the transducer, the aerosol optionally enters a heat exchanger 24 that prevents the aerosol from condensing inside the system and aids in the rapid movement of the aerosol into the fuel-injection system through an optional fire arrestor 26.

Figure 10:
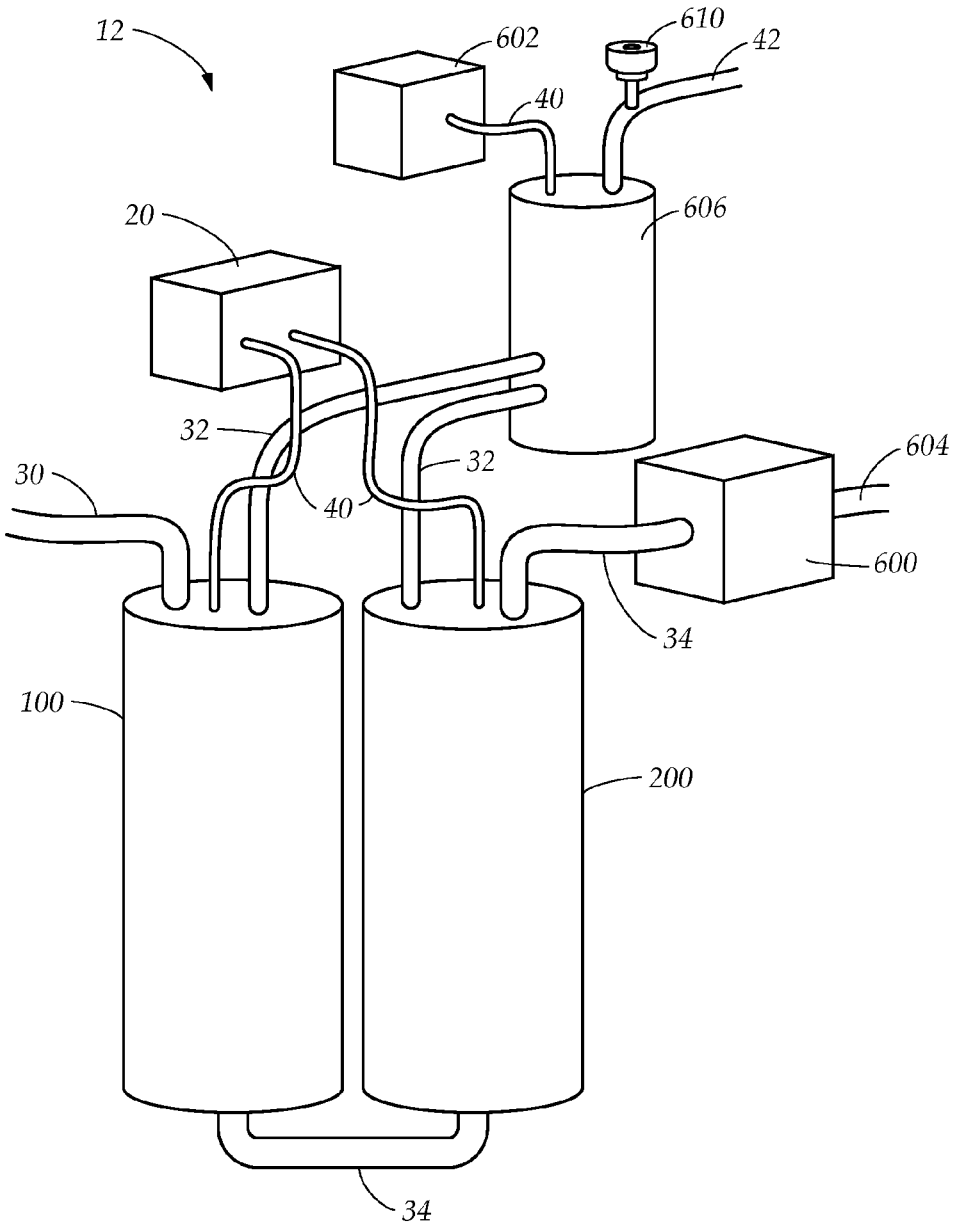
FIG. 10 is a schematic diagram of a further embodiment of the pre-injection fuel atomization system for an engine, having an air heating system and kinetic energy module.

FIG. 10 is another example embodiment of fuel atomization system. The fuel is introduced into the system through the fuel hose 30 into the fuel holding chamber. Air enters the system through an air heater 606 through an air hose 42 that is regulated by a valve 610. An internal heater controlled by a heater controller 602 heats the air, providing kinetic energy to the air before mixing with the fuel in the fuel holding chamber. The heater controller controllers the temperature relationship between the fuel and air to achieve a stoichiometric ratio of fuel and oxygen in the air. The air enters exits the heater through at least one hose 32 in fluid communication with the fuel holding chamber 100.

The aerosol is formed in the transducer chamber 200 as described hereinabove. The fuel in the aerosol evaporates into a vapor state and air containing fuel vapor and oxygen, now at a stoichiometric ratio passes into a kinetic energy module 600, the module providing heat energy to maintain the stoichiometric ratio. The kinetic heat energy promotes evaporation of the suspended droplets in the aerosol, preventing the droplets from returning to a liquid state and separating into heavier droplets. The heat energy maintains the ratio by keeping the fuel in a vapor state.

In one embodiment, the heat energy is provided by an infrared heater.

In a further embodiment, the transducer is under higher pressure when the microscopic droplets of fuel are formed, increasing the kinetic energy per droplet. The higher energy droplets displace air molecules at normal atmospheric pressure at a higher rate, creating a stoichiometric fuel to oxygen ratio.

FIG. 10 demonstrates a method for creating, maintaining and delivering a stoichiometric ratio of fuel to oxygen to an internal combustion engine, for cleaner, more efficient combustion. The fuel is atomized into a multiplicity of microscopic droplets by passing the fuel over a vibrating crystal in the transducer, the droplets forming an aerosol with air, the air containing oxygen.

A stoichiometric ratio of oxygen to fuel is created and maintained in the aerosol by controlling the temperature relationship between the fuel droplets and air, by initially heating the air by an air heater 606 as it flows into the fuel holding chamber 100 and in the transducer chamber 200 and controlling the flow rate of the aerosol in the system by the controller 20.

The system provides a continuing source of kinetic energy by a kinetic energy module 600, the kinetic energy as heat operative for maintaining the droplets in the aerosol at a stoichiometric ratio prior to entering an internal combustion engine through an output hose 604, the stoichiometric ratio providing complete combustion of the fuel, operative for cleaning an exhaust stream by reducing hydrocarbons in the stream and increasing the efficiency of the fuel.

In one embodiment, the step of atomizing the fuel into multiplicity of droplets is performed under pressures higher than conventional pressures, thereby increasing kinetic energy in each droplet, the increased energy operative for a lower molecular weight density, the lower density droplets displacing more air molecules at atmospheric pressure in the aerosol at a higher rate, operative for achieving a stoichiometric ratio of oxygen to fuel.

In a further embodiment, the stoichiometric ratio in the aerosol is maintained by additionally regulating an orifice diameter by a valve 610 in an aerosol pathway in the system.

The stoichiometric ratio in the aerosol is further maintained by heating the air by the air heater 606, increasing the kinetic energy of air operative for controlling the temperature relationship between the fuel and the air, the kinetic energy of air increasing before atomizing the fuel into a multiplicity of microscopic droplets.

The fuel atomizes into a multiplicity of microscopic droplets by passing over the crystal in the transducer 200 vibrating at a frequency about 1.7 MHz, deforming between a plurality of convex and concave conformations.

The crystal deforms between convex and concave conformations in response to the square wave signal from the ignition system, the signal transmitted by the controller 20 to the crystal.

The crystal atomizes the fuel into microscopic droplets having a droplet size generally ranging from 0.8 microns to around 0.1 microns.

As shown in FIG. 1, the system is assembled by coupling at least one fuel holding chamber 100 having the float within to at least one transducer chamber 200 having a vibrating crystal, the at least one fuel holding chamber in fluid communication with the at least on transducer chamber through the fuel hose. The float and the crystal are electrically coupled to the controller and the controller 20 is electrically coupled to the ignition system. The at least one fuel holding chamber 100 is coupled to the fuel pump of the engine, the fuel pump in fluid communication with the fuel holding chamber. The transducer chamber 200 is coupled to a fuel injection system of the internal combustion engine, the fuel injection system in fluid communication with the transducer chamber through the fuel hose 30.

In one embodiment shown in FIG. 10, the transducer chamber 200 is coupled to a kinetic energy module 600, the module further coupling to the fuel injection system through an output hose 604. The kinetic energy module maintains fluid communication between the fuel injection system and the transducer chamber 200 while maintaining the kinetic energy of the aerosol.

Prototypes of the pre-injection fuel atomization system for a combustion engine have been installed on various vehicles for testing purposes. The following is a summary of the results. EPA is the Environmental Protection Agency and mpg is miles per gallon.

| Vehicle | Engine | EPA Estimated Fuel Economy in mpg | Fuel Atomization System Results in mpg | Fuel Atomization Advantage |
|---|---|---|---|---|
| 2010 Ford | 5.4 L 3-valve | 14 | 23.2 | 65.7% |
| F150 Lariat | V8 FFV | 20 | 29.3 | 46.5% |
| 2006 Mini | 1.6 L 4-cyl. | 24 | 38.9 | 62.1% |
| Cooper | engine | 33 | 60.1 | 82.1% |
| 97 Toyota | 1.8 liter | 18 | 36.5 | 102.8% |
| Tacoma | engine | 20 | 41.44 | 107.2% |

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a pre-injection fuel atomization system for a combustion engine. The disclosure is illustrated by example in the drawing figures, and throughout the written description. It should be understood that numerous variations are possible, while adhering to the inventive concept. Such variations are contemplated as being a part of the present disclosure.

What is claimed is:

1. A pre-injection fuel atomization system for cleaner, more efficient combustion in an internal combustion engine, comprising:

at least one fuel holding chamber having a float therein, the float monitoring the amount of fuel in the chamber and signaling the amount of fuel in the chamber, the at least one fuel holding chamber in fluid communication with a fuel pump;

at least one transducer chamber having a transducer therein with a vibrating crystal, the vibrating crystal operative for atomizing fuel into an aerosol, the aerosol having a multiplicity of microscopic fuel droplets in air, the transducer in fluid communication with the at least one fuel holding chamber and in fluid communication with a fuel injection system of an internal combustion engine; and a controller in electrical communication with an ignition system of the internal combustion engine, the controller in electrical communication with the float and regulating flow rate of fuel into the at least one fuel holding chamber in response to the signal from the float and further regulating the flow rate and volume of fuel from the fuel holding chamber into the transducer chamber, the controller in electrical communication with the vibrating crystal in the at least one transducer chamber, the vibrating crystal producing the fuel aerosol, the fuel aerosol flowing from the at least one transducer chamber to the fuel injection system operative for introducing the aerosol to the engine, the aerosol cleanly and efficiently burning in the internal combustion engine.

2. The system as described in claim 1, wherein the crystal is a resonating crystal operative for atomizing the fuel in the aerosol by reverse piezoelectricity.

3. The system as described in claim 2, wherein the crystal vibrates at a frequency about 1.7 MHz, deforming between a plurality of convex and concave conformations.

4. The system as described in claim 3, wherein the crystal deforms in response to a square wave signal from the ignition system, the signal transmitted by the controller to the crystal.

5. The system as described in claim 4, wherein the crystal atomizes the fuel into microscopic droplets having a droplet size generally ranging from 0.8 microns to around 0.1 microns.

6. The system as described in claim 5, the microscopic droplets have an increased surface area per volume of fuel, providing more rapid vaporization and combustion, thereby increasing the fuel efficiency of the fuel.

7. The system as described in claim 6, wherein the air in system has oxygen and the system maintains the fuel droplets in the aerosol at a stoichiometric ratio to the oxygen in the air prior to entering an internal combustion engine, the stoichiometric ratio providing more complete combustion of the fuel, operative for a cleaner exhaust stream by reducing hydrocarbons in the exhaust and increasing the efficiency of the fuel combustion.

8. The system as described in claim 7, wherein the system further comprises a continuing source of kinetic energy, the kinetic energy as heat, the heat operative for maintaining the kinetic energy of the droplets in the aerosol, the kinetic energy of the droplets maintaining the stoichiometric ratio of fuel to oxygen in the aerosol.

9. The system as described in claim 7, wherein the system further comprises a manifold chamber in fluid communication with the at least one transducer chamber and the fuel injection system, the manifold having a wall with a plurality of openings, each opening having a curved channel with an end opening, the end opening directed in an arch back to the wall, creating a vortex when the aerosol enters the chamber from the transducer chamber.

10. The system as described in claim 9, wherein the vortex moves the droplets ranging in size up to 0.2 μm into a low pressure conduit having about 2.7 W.G pressure differential compared to the manifold chamber, the conduit in fluid communication with the manifold chamber and the fuel injection system.

11. The system as described in claim 10, wherein the manifold chamber and the transducer chamber form a single combined transducer manifold chamber, the transducer in a bottom portion and the manifold in a top portion.

12. A method for creating, maintaining and delivering a stoichiometric ratio of fuel to oxygen to an internal combustion engine, for cleaner, more efficient combustion, comprising:

atomizing a fuel into a multiplicity of microscopic droplets by passing the fuel over a vibrating crystal, the droplets forming an aerosol with air, the air containing oxygen;

maintaining a stoichiometric oxygen to fuel ratio in the aerosol by controlling the temperature relationship between the fuel droplets and air, and further controlling the flow rate of the aerosol; and providing a continuing source of kinetic energy, the kinetic energy as heat operative for maintaining the droplets in the aerosol at a stoichiometric ratio prior to entering an internal combustion engine, the stoichiometric ratio providing complete combustion of the fuel, operative for cleaning an exhaust stream by reducing hydrocarbons in the stream and increasing the efficiency of the fuel.

13. The method as described in claim 12, wherein the step of atomizing the fuel into multiplicity of droplets is performed under pressures higher than conventional pressures, thereby increasing kinetic energy in each droplet, the increased energy operative for a lower molecular weight density, the lower density droplets displacing air molecules at atmospheric pressure in the aerosol at a higher rate, operative for achieving a stoichiometric ratio of oxygen to fuel.

14. The method as described in claim 13, wherein the step of maintaining a stoichiometric ratio in the aerosol includes regulating an orifice diameter by a valve in an aerosol pathway in the system.

15. The method as described in claim 14, further comprising the step of heating the air, thereby increasing the kinetic energy of air, operative for controlling the temperature relationship between the fuel and the air precedes the step of atomizing a fuel into a multiplicity of microscopic droplets.

16. The method as described in claim 14, wherein the step of atomizing a fuel into a multiplicity of microscopic droplets by passing the fuel over a vibrating crystal includes the step of the crystal vibrating at a frequency about 1.7 MHz, deforming between a plurality of convex and concave conformations.

17. The method as described in claim 16, wherein the step of the crystal deforming between convex and concave conformations includes the step of the crystal deforming in response to a square wave signal from the ignition system, the signal transmitted by a controller to the crystal.

18. The method as described in claim 17, wherein the crystal atomizes the fuel into microscopic droplets having a droplet size generally ranging from 0.8 microns to around 0.1 microns.

19. A method for providing a pre-injection fuel atomization system in an internal combustion engine, comprising:

coupling at least one fuel holding chamber, the holding chamber having a float, to at least one transducer chamber, the transducer chamber having a vibrating crystal operative for atomizing fuel into an aerosol, the at least one fuel holding chamber in fluid communication with the at least on transducer chamber;

electrically coupling the float and the crystal to a controller, the controller electrically coupled to an ignition system producing a square wave signal;

coupling the at least one fuel holding chamber to a fuel pump of an internal combustion engine, the fuel pump in fluid communication with the fuel holding chamber; and coupling the transducer chamber to a fuel injection system of the internal combustion engine, the fuel injection system in fluid communication with the transducer chamber.

20. The method of described in claim 19, wherein the step of coupling the transducer chamber to a fuel injection system includes the step of coupling the transducer chamber to a kinetic energy module, the module further coupling to the fuel injection system, the module maintaining fluid communication between the fuel injection system and the transducer chamber.

* * * * *